US005207738A

United States Patent [19]

Dey

[11] Patent Number: 5,207,738

[45] Date of Patent: May 4, 1993

[54] HEAT EXCHANGER MANIFOLD ASSEMBLY

[75] Inventor: LaVoyce Dey, Youngsville, Pa.

[73] Assignee: Valeo, Jamestown, N.Y.

[21] Appl. No.: 936,939

[22] Filed: Aug. 28, 1992

[51] Int. Cl.[5] ..... F28F 9/02

[52] U.S. Cl. ..... 165/175; 165/153; 165/173; 29/890.052

[58] Field of Search ..... 165/153, 173, 175, 176; 29/890.052, 890.08

[56] References Cited

U.S. PATENT DOCUMENTS

| | | | |
|---|---|---|---|
| 3,866,675 | 2/1975 | Bardon et al. | 165/173 |
| 4,945,635 | 8/1990 | Nobusue et al. | 29/890.043 |
| 5,082,051 | 1/1992 | Ando | 165/110 |
| 5,092,398 | 3/1992 | Nishishita et al. | 165/153 |
| 5,172,762 | 12/1992 | Shinmura et al. | 165/173 |

FOREIGN PATENT DOCUMENTS

| | | | |
|---|---|---|---|
| 450619 | 10/1991 | European Pat. Off. | 165/173 |
| 2-309196 | 12/1990 | Japan | 165/173 |

*Primary Examiner*—Allen J. Flanigan
*Attorney, Agent, or Firm*—Morgan & Finnegan

[57] ABSTRACT

The invention involves a heat exchanger in which manifold constructions which encompass tubular elements of the heat exchanger are formed of two mated manifold portions. Each of the manifold portions have slots which when the portions are mated and joined encompass the tubular elements. End plates are included in the structure by insertion of the end plates into grooves formed in the ends of the separate manifold portions.

4 Claims, 1 Drawing Sheet

HEAT EXCHANGER MANIFOLD ASSEMBLY

BACKGROUND OF THE INVENTION

Heat exchangers which employ two spaced header and tank constructions and wherein generally parallel, open ended tubes interconnect the header and tank constructions and are in fluid communication with the interior of the header and tank constructions are known. Plate or serpentine fins can be disposed across the tubes between the header and tank constructions. These heat exchangers can be used in vehicular radiators and as air conditioner condensers, evaporators and the like.

Structural improvements in such heat exchangers are desired to enhance the ease of manufacture and reduce the cost of manufacture and manpower while maintaining or improving durability and reliability. A round tube (1 pc) is always lighter. Lighter and more effective heat exchangers especially for vehicular radiators and air conditioners are sought after advantages.

OBJECTS AND SUMMARY OF THE INVENTION

The present invention seeks to achieve the improvements which have been sought after by the prior art as pointed out.

The present invention relates to a heat exchanger and, more particularly, to a heat exchanger in which manifold constructions which encompass the tubular elements of the heat exchanger are formed of two manifold portions. Each of the manifold portions have slots which when the portions are mated and joined encompass the tubular elements.

DETAILED DESCRIPTION OF THE INVENTION

The present heat exchanger assembly comprises spaced generally parallel manifold constructions between which extend a plurality of tubular elements. Each manifold construction of the heat exchanger assembly has end plates at or adjacent its ends.

The manifold constructions comprise separate first and second manifold portions wherein the first manifold portion can be mated with the second manifold portion.

Each of the manifold portions have elongated slots in one of its sides. The slots of the first manifold portion correspond to the slots of the second manifold portion so that a core assembly of tubular elements and separators between the elements can extend between the generally parallel manifold constructions.

The end plates of the manifold construction are inserted and held in place by grooves which are formed in the inner surface adjacent to or at the ends of the first and second manifold portions.

One of the first or second manifold portions can have at least one tab depending from a side thereof which can be bent over the other manifold portion to hold the assembly together prior to brazing.

If desired, the manifold constructions can be modified to contain partitioned spaces or chambers by the insertion of at least one baffle means within the manifold construction.

The baffle means are held within the manifold construction by insertion in grooves which are formed in the inner surface of the first and second manifold portions.

The baffles and end plates are of a form or shape such that they fill the space between the manifold parts in which they are inserted.

The end plates can have spherical depressions formed in their sides which face inwardly of the manifold construction and which are primarily used for cleaning and assembly.

DETAILED DESCRIPTION OF THE FIGURES

Figure 1:
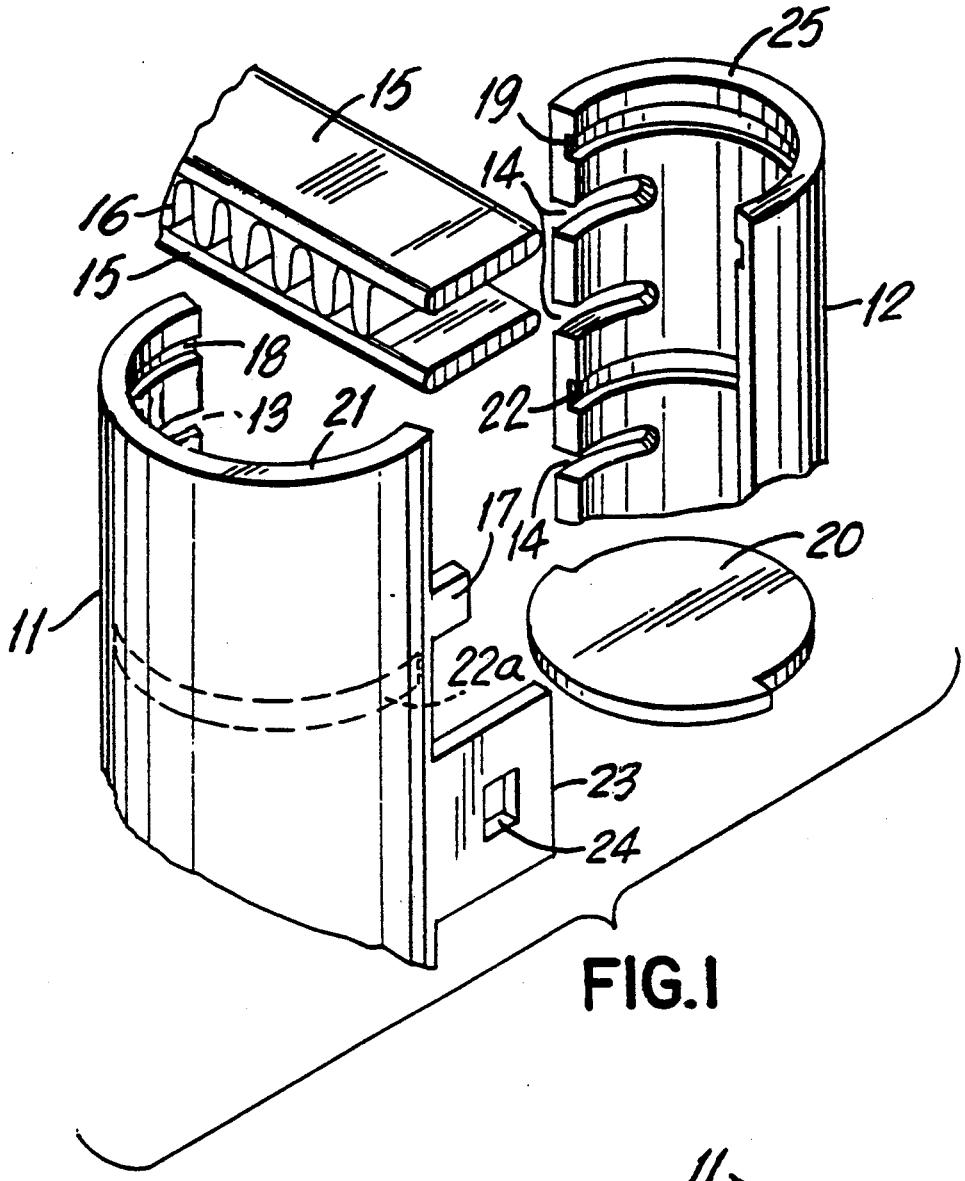
FIG. 1 shows a perspective view of the heat exchanger assembly of the present invention.
Figure 2:
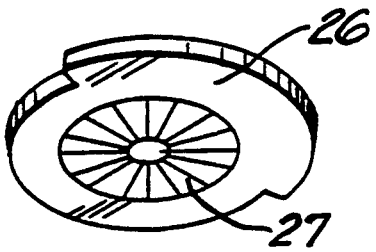
FIG. 2 shows an end plate useful in the present heat exchanger assembly.

FIG. 1 is a perspective view of an embodiment of the invention wherein the overall heat exchanger construction comprises a first manifold portion 11, a second manifold portion 12 and an assembly of tubular elements 15 and separators 16 as serpentine fins between the tubular elements 15. Each of the first manifold portion 11 and second manifold portion 12 has multiple tubular element slots 13, 14. The slots 13 and 14 are so sized that the tubular elements 15 will be entirely encompassed by the slots when manifold portions 11 and 12 are mated and joined. In the embodiment shown in FIG. 1, the slot 13 in manifold portion 11 is at least one half the size of the width of a tubular element 15 and slot 14 in manifold portion 12 is greater than one half the width of tubular element 15. Slots 14 can have a lead in as seen in the figure. Adjacent the ends 21 of manifold portion 11 and ends 25 of manifold portion 12 there are provided grooves 18, 19 in the respective manifold portions 12, 11. These grooves 18, 19 are sized to accept and hold end plate 20 (or 26) of the manifold construction. If desired, grooves 22, 22A in the interior surfaces of the manifold portions 11, 12 can be provided in order to accept plates 20 (or 26) so as to form internal partitions or chambers in the manifold construction. Manifold portion 12 can also have aligning tabs. End plate 26 (FIG. 2) is an embodiment with a spherical shaped indentation which aids in cleaning of said components and handling of the flat surface items, and prevents sticking together of said components during assembly operations.

Tabs 17 are provided on manifold portion 11 which are adapted to be bent over manifold portion 12 after mating of the two portions and to hold the construction together prior to brazing. Manifold portion 11 also may have a tab 23 which can be used to attach mounting brackets (not shown). Tab 23 may have holes/slots such as 24 for the retention of brackets.

Figure 3:
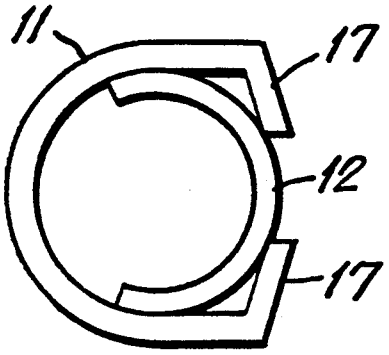
FIG. 3 shows a cross-sectional end view of a manifold construction.

The halves which form the manifold partition portions can be blanked from a flat sheet of material and grooves for the end caps and baffles, if desired are formed. Then the halves are formed into the desired shape of the final product. In the embodiment shown in FIG. 1, the halves have been formed to the proper roundness. A preferred form of the present invention as shown in FIG. 1 is one where one of the two manifold portions is smaller than the other and the smaller manifold portion nests within the larger manifold portion and is held in place by tabs 17 as can be seen in the cross-sectional end view of FIG. 3.

The heat exchanger assembly can be constructed by placing the end plate (and baffles, if desired) into grooves in one of the manifold portions, preferably the smaller diameter manifold portion. Tubular elements and separators (15 and 16, in FIG. 1) are stacked in a manner so that the distance between the tubular elements corresponds to the distances between the slots in the manifold portions. The tubular element (separator core assembly) is placed into the slots of the manifold portions and the second manifold portion is mated with the first manifold portion to form the manifold assembly having the core assembly. The retainer tabs are then bent over to hold the entire assembly together prior to brazing.

What is claimed is:

1. A heat exchanger comprising: spaced generally parallel manifold constructions between which extend a plurality of tubular elements, each manifold construction having an end with an end plate;

the manifold constructions comprising separate first and second manifold portions wherein the first manifold portion can be mated with the second manifold portion;

each of the manifold portions having at one side thereof elongated slots, the slots of the first manifold portion corresponding to the slots of the second manifold portion so that the tubular elements extending between the generally parallel manifold constructions can be received and encompassed by the slots; and the end plates of the manifold construction being inserted and held in place by grooves adjacent to the ends of the first and second manifold portions.

2. A heat exchanger according to claim 1, wherein one of the first or second manifold portions have at least one tab depending from a side thereof which can be bent over the other manifold portion.

3. A heat exchanger according to claim 1, wherein the manifold construction further comprises at least one baffle means to form partitions within the manifold construction.

4. A heat exchanger according to claim 3, wherein the baffle means is held within the manifold construction by insertion in grooves in inner surfaces of the first and second manifold portions.

* * * * *